US009562526B2

(12) United States Patent
Roman et al.

(10) Patent No.: US 9,562,526 B2
(45) Date of Patent: Feb. 7, 2017

(54) ARRANGEMENT OF COMPONENTS OF A LINEAR COMPRESSOR

(75) Inventors: Alisson Luiz Roman, Joinville, SC (US); Celso Kenzo Takemori, Joinville, SC (US); Paulo Rogerio Carrara Couto, Joinville, SC (US); Wilfred Roettger, Joinville, SC (US)

(73) Assignee: Whirlpool S.A., São Paulo, SP (BR)

( * ) Notice: Subject to any disclaimer, the term of this patent is extended or adjusted under 35 U.S.C. 154(b) by 254 days.

(21) Appl. No.: 14/131,099

(22) PCT Filed: Jun. 21, 2012

(86) PCT No.: PCT/BR2012/000211

§ 371 (c)(1),
(2), (4) Date: Apr. 23, 2014

(87) PCT Pub. No.: WO2013/003922

PCT Pub. Date: Jan. 10, 2013

(65) Prior Publication Data

US 2014/0234145 A1 Aug. 21, 2014

(30) Foreign Application Priority Data

Jul. 7, 2011 (BR) ..... 1103647

(51) Int. Cl.
*F04B 35/04* (2006.01)
*F04B 39/00* (2006.01)

(52) U.S. Cl.
CPC ..... *F04B 39/0005* (2013.01); *F04B 35/045* (2013.01); *F04B 39/0044* (2013.01)

(58) Field of Classification Search
CPC ..... F04B 39/127; F04B 39/10; F04B 39/0005; F04B 39/0044; F04B 27/10; F04B 35/04; F04B 35/045; F04B 39/005; H02K 22/02; F16F 1/18; F16F 1/185; F16F 1/187; F16F 1/26; F16F 3/00
(Continued)

(56) References Cited

U.S. PATENT DOCUMENTS 2,322,913 A * 6/1943 Best ..... F02M 37/08 310/34
2,934,256 A * 4/1960 Lenning ..... F04B 35/045 417/274
(Continued)

FOREIGN PATENT DOCUMENTS

JP 2004-140901 A 5/2004
PA 0902557 A2 * 7/2009 ..... F04B 39/12
(Continued)

OTHER PUBLICATIONS

International Search Report for International Application No. PCT/BR2012/000211 mailed Oct. 19, 2012.

*Primary Examiner* — Peter J Bertheaud
*Assistant Examiner* — Dnyanesh Kasture
(74) *Attorney, Agent, or Firm* — Brian J. Colandreo; Michael T. Abramson; Holland & Knight LLP

(57) ABSTRACT

The present invention refers to the arrangement of components comprised in a linear compressor (1), which is fundamentally composed by at least one resonant oscillating mechanism comprising at least one resonant spring (2) which defines at least one neutral point (21), at least one magnet (3) and at least one piston (4); at least one intermediate element (5) which defines an axially flexible surface (51); at least one flat spring (6) which defines at least one binding structure (62); at least one shell (7); and at least one attaching means (8).

4 Claims, 3 Drawing Sheets

(58) Field of Classification Search
USPC ..... 417/416, 417, 481
See application file for complete search history.

(56) References Cited

U.S. PATENT DOCUMENTS 2,954,917 A * 10/1960 Bayer ..... F04B 35/045 417/417
3,171,585 A * 3/1965 Gauss ..... F04B 35/045 417/417
3,250,219 A * 5/1966 McCarty ..... F02M 37/08 137/492
3,267,866 A * 8/1966 Unger ..... F04B 17/046 417/417
3,325,085 A * 6/1967 Gaus ..... F04B 35/045 417/416
3,462,136 A * 8/1969 Rumsey ..... F16F 1/326 188/268
3,588,291 A * 6/1971 Curwen ..... F04B 35/045 417/417
3,781,140 A * 12/1973 Gladden ..... H02K 33/18 310/27
3,786,834 A * 1/1974 Garland ..... F16K 15/08 137/512.1
3,810,719 A * 5/1974 Wolthers ..... F01L 25/08 417/317
4,044,628 A * 8/1977 Jacks ..... F16F 15/1213 188/268
4,116,591 A * 9/1978 Mardell ..... F02M 51/04 310/80
4,145,936 A * 3/1979 Vincent ..... B64C 27/001 416/500
4,225,287 A * 9/1980 Vincent ..... B64C 27/001 416/145
4,568,250 A * 2/1986 Falk ..... A61M 5/14216 417/254
4,569,641 A * 2/1986 Falk ..... A61M 5/14216 310/104
4,636,150 A * 1/1987 Falk ..... A61M 5/14216 310/104
4,795,012 A * 1/1989 Durum ..... F16D 3/52 192/207
4,827,968 A * 5/1989 Brown ..... F04B 53/1032 137/270
4,872,767 A * 10/1989 Knapp ..... F01D 25/164 384/535
5,022,832 A * 6/1991 Lauterbach ..... F04B 39/1033 137/516.15
5,147,246 A * 9/1992 Focqueur ..... F16F 15/1213 192/207
5,597,294 A * 1/1997 McGrath ..... F04B 35/04 417/417
5,697,848 A * 12/1997 Bosley ..... F01D 5/02 415/216.1
5,779,455 A * 7/1998 Steiger ..... F04B 35/045 267/161
5,797,733 A * 8/1998 Falk ..... A61M 5/14216 417/307
5,895,033 A * 4/1999 Ross ..... F16F 7/116 267/161
6,015,273 A * 1/2000 Hannagan ..... F04B 35/045 417/417
6,412,586 B1 * 7/2002 Askew ..... F01N 13/00 180/309
6,457,704 B1 * 10/2002 Van Eerden ..... B60G 11/52 267/166
6,540,490 B1 * 4/2003 Lilie ..... F04B 35/045 417/416
6,585,091 B2 * 7/2003 Reinhart ..... F16F 1/34 192/203
6,622,839 B2 * 9/2003 Kundermann ..... F16D 25/0638 192/207
6,884,044 B2 * 4/2005 Lilie ..... F04B 35/045 417/363
6,966,760 B1 * 11/2005 Radue ..... F04B 17/042 417/205
7,163,384 B2 * 1/2007 Lilie ..... F04B 35/045 267/179
7,215,047 B2 * 5/2007 Lilie ..... H02K 33/16 310/15
7,316,547 B2 * 1/2008 Lilie ..... F04B 35/045 417/415
7,717,792 B2 * 5/2010 Chaudhari ..... F16D 3/77 464/99
7,896,623 B2 * 3/2011 Hell ..... F04B 35/045 248/605
7,988,430 B2 * 8/2011 Kang ..... F04B 35/045 417/416
8,033,795 B2 * 10/2011 Dainez ..... F04B 35/045 318/687
8,038,418 B2 * 10/2011 Hell ..... F04B 35/045 417/363
D658,681 S * 5/2012 Takemori ..... D15/7
D658,682 S * 5/2012 Takemori ..... D15/9
D658,683 S * 5/2012 Takemori ..... D15/9
8,360,749 B2 * 1/2013 Morrone ..... F04B 35/045 29/890.035
8,794,934 B2 * 8/2014 Kang ..... F04B 17/04 310/12.15
8,998,589 B2 * 4/2015 Lilie ..... F04B 35/045 417/410.1
9,004,885 B2 * 4/2015 Ki ..... F04B 35/045 417/363
2002/0164255 A1 * 11/2002 Burr ..... F04B 45/047 417/363
2003/0017064 A1 * 1/2003 Kawahara ..... F04B 35/045 417/417
2004/0022651 A1 * 2/2004 Hashimoto ..... F04B 17/046 417/417
2004/0074700 A1 * 4/2004 Lilie ..... F04B 35/045 184/6.16
2004/0115076 A1 * 6/2004 Lilie ..... F04B 35/045 417/416
2004/0145247 A1 * 7/2004 Lilie ..... H02K 33/02 310/156.01
2004/0156730 A1 * 8/2004 Lilie ..... F04B 35/045 417/363
2005/0025638 A1 * 2/2005 Buffet ..... F04B 17/046 417/416
2005/0260086 A1 * 11/2005 Park ..... F04B 35/045 417/417
2006/0008366 A1 * 1/2006 Kingsford ..... F04B 9/02 417/417
2006/0018771 A1 * 1/2006 Song ..... F04B 35/045 417/416
2006/0024181 A1 * 2/2006 Kim ..... F04B 35/045 417/417
2006/0057000 A1 * 3/2006 Hyeon ..... F04B 35/045 417/415
2006/0127249 A1 * 6/2006 Lilie ..... F04B 35/045 417/417
2006/0220473 A1 * 10/2006 Ueda ..... H02K 33/16 310/12.25
2007/0041855 A1 * 2/2007 Hansen ..... F04B 35/045 417/417
2007/0041856 A1 * 2/2007 Hansen ..... F04B 49/14 417/417
2007/0110600 A1 * 5/2007 Park ..... F04B 35/045 417/417
2008/0008607 A1 * 1/2008 Schade ..... F04B 35/045 417/410.1
2008/0075610 A1 * 3/2008 Bonniface ..... F04B 35/045 417/417
2008/0089796 A1 * 4/2008 Schade ..... F04B 35/045 417/417
2008/0112829 A1 * 5/2008 Hell ..... F04B 35/045 417/546
2008/0134833 A1 * 6/2008 Lilie ..... F04B 35/045 74/581

(56) References Cited

U.S. PATENT DOCUMENTS

2009/0081049 A1* 3/2009 Tian ..... F04B 35/045 417/18
2009/0081058 A1* 3/2009 Ishibashi ..... F04B 35/045 417/417
2009/0120967 A1* 5/2009 Bensley ..... F04B 9/02 222/333
2009/0129955 A1* 5/2009 Schubert ..... F04B 35/045 417/417
2009/0280015 A1* 11/2009 Lillie ..... F04B 35/045 417/416
2010/0296951 A1* 11/2010 Lee ..... F04B 35/045 417/417
2010/0310393 A1* 12/2010 Lee ..... H02K 33/16 417/417
2011/0008191 A1* 1/2011 Lilie ..... F04B 35/045 417/410.1
2011/0044831 A1* 2/2011 Cunningham ..... F04D 1/063 417/410.1
2011/0058966 A1* 3/2011 Cunningham ..... F04D 13/10 417/410.1
2012/0251359 A1* 10/2012 Neelakantan ..... F04B 17/046 417/416
2013/0121855 A1* 5/2013 Lilie ..... F04B 35/045 417/363
2014/0007765 A1* 1/2014 Takemori ..... F04B 35/045 92/137
2014/0234137 A1* 8/2014 Roman ..... F04B 35/045 417/363
2014/0234145 A1* 8/2014 Roman ..... F04B 35/045 417/481
2014/0241911 A1* 8/2014 Roman ..... F04B 35/045 417/328
2014/0301874 A1* 10/2014 Roettger ..... F04B 35/045 417/437
2014/0340003 A1* 11/2014 Silvia ..... F04B 35/045 318/128
2015/0040752 A1* 2/2015 Roman ..... F04B 39/0022 92/172
2015/0219095 A1* 8/2015 Muhle ..... F04B 39/0292 92/169.1
2015/0226200 A1* 8/2015 Beers ..... F04B 35/045 417/416
2015/0226201 A1* 8/2015 Beers ..... F04B 35/045 417/363
2015/0226202 A1* 8/2015 Beers ..... F04B 39/0005 417/363
2015/0226210 A1* 8/2015 Barito ..... F04B 35/045 417/415

FOREIGN PATENT DOCUMENTS

WO WO 9428306 A1 * 12/1994 ..... F04B 35/04
WO WO 9918649 A1 * 4/1999 ..... F04B 35/045
WO 2007/118295 A1 10/2007
WO WO 2007118295 A1 * 10/2007 ..... F04B 35/045
WO WO 2011003163 A1 * 1/2011 ..... F04B 35/04
WO 2012/088572 A1 6/2012
WO WO 2013026115 A1 * 2/2013 ..... F04B 35/045
WO WO 2013029133 A1 * 3/2013 ..... F04B 35/045

* cited by examiner

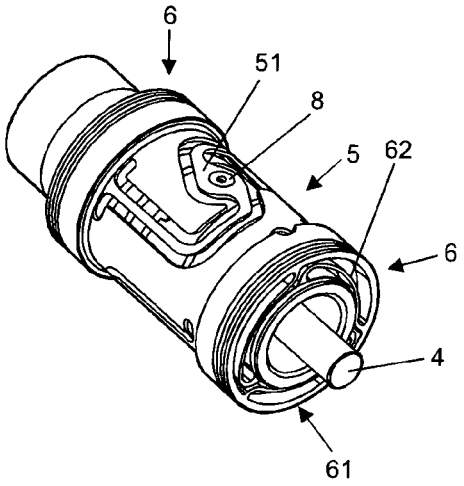
FIG. 1
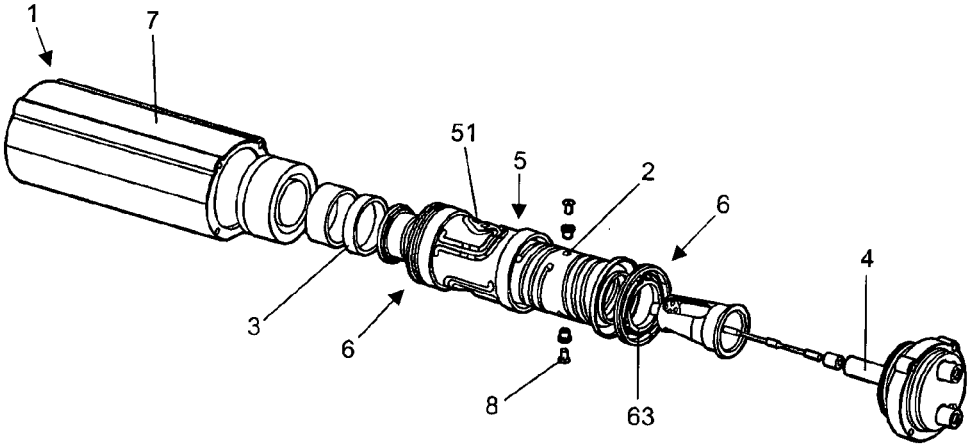
FIG. 2.1

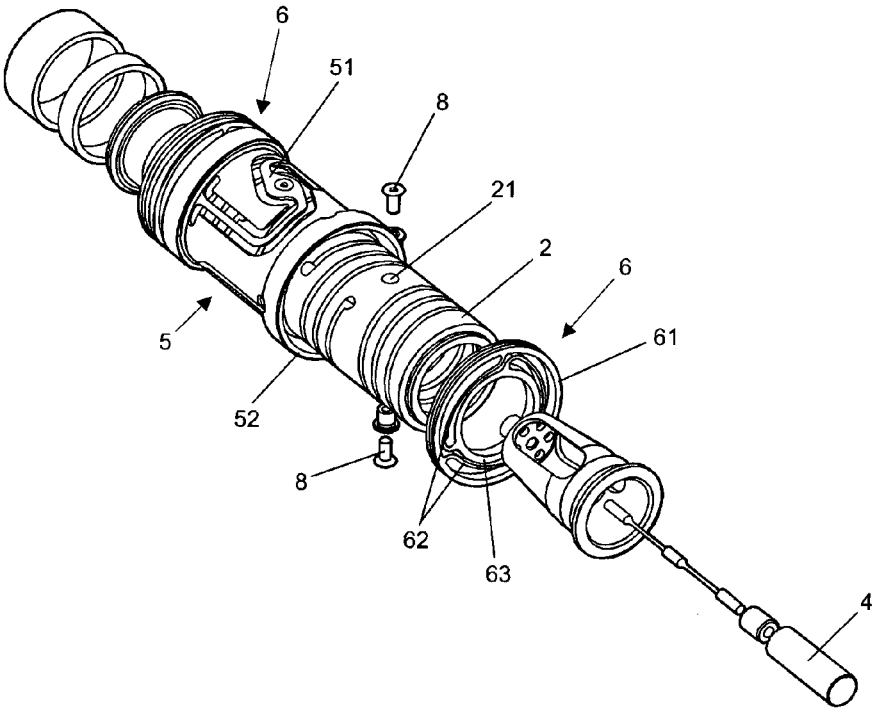
FIG. 2.2
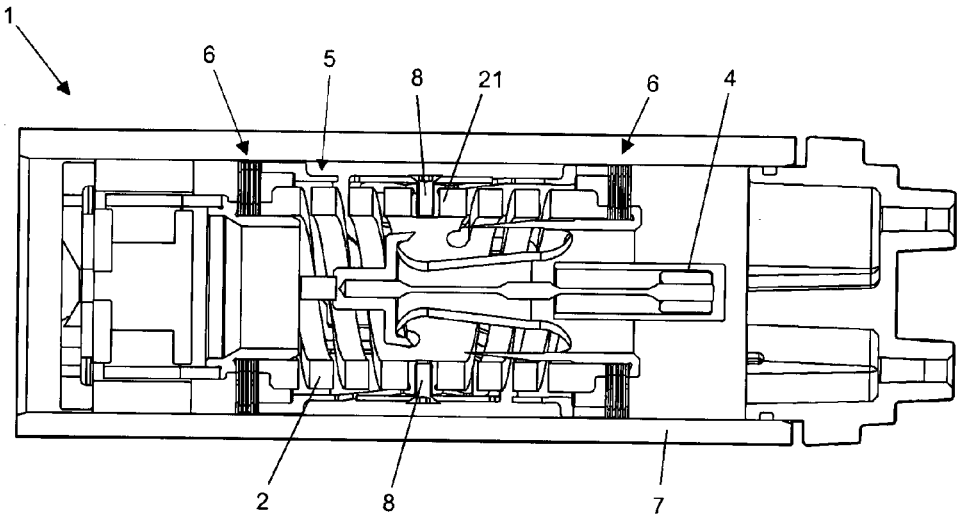
FIG. 3.1

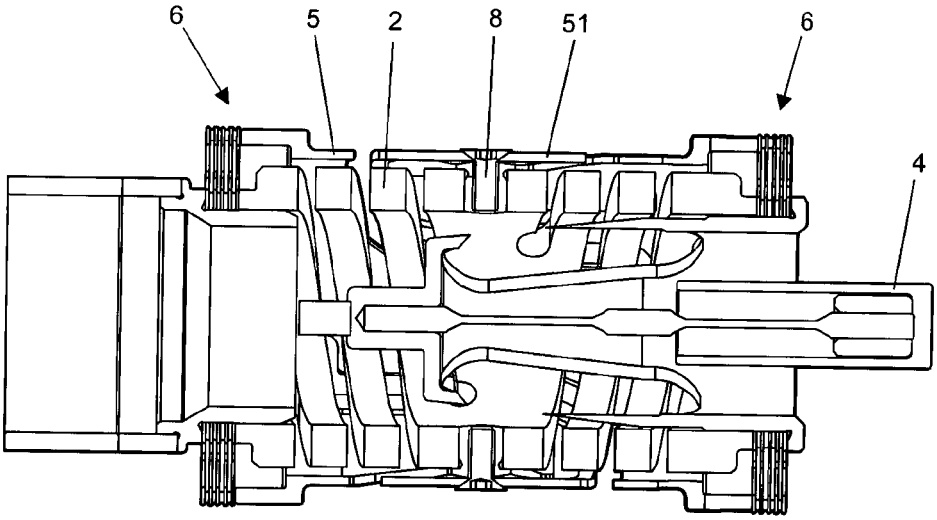
FIG. 3.2

ARRANGEMENT OF COMPONENTS OF A LINEAR COMPRESSOR

RELATED APPLICATIONS

The subject application is a U.S. National Stage Application of International Application No. PCT/BR2012/000211, filed on 21 Jun. 2012, which claims the priority of Brazil Patent Application No.: PI1103647-8, filed on 7 Jul. 2011, the contents of which are herein incorporated by reference in its entirety.

FIELD OF THE INVENTION

The present invention refers to the arrangement of components that compose a linear compressor. Thus, more specifically, the present invention deals with the alignment of certain means of support of a linear compressor that is based on a resonant oscillating mechanism.

BACKGROUND OF THE INVENTION

According to the skilled in the art, linear compressors comprise at least one arrangement wherein the piston is functionally associated with a linear electrical engine, wherein the objective of this arrangement consists of axially moving the piston in the interior of a cylinder, promoting the compression of a working fluid.

Thus, the skilled in the art already known linear compressors based on resonant oscillating mechanisms, wherein the piston (which glides in the interior of a cylinder, promoting the compression of a working fluid) and the linear engine (fundamentally composed by a fixed stator and a movable magnet) have their motion dynamics defined by means of a body with resilient features and which is susceptible of resonant linear vibration (which comprises the attaching element between the piston and the magnet of the linear engine).

Some functional examples of linear compressors based on resonant oscillating mechanisms are described in document BRPI0601645. One of these functional examples comprises a compressor wherein the magnet of the linear engine is attached to the piston by means of a resilient element as a resonant helical spring, wherein said piston (together with corresponding attaching elements thereof) is arranged in one of the ends of the resilient element, while the magnet (together with corresponding attaching elements thereof) is arranged in its opposed end. This arrangement enables that the movement between the opposed ends of the resilient element presents a difference of 180° (a hundred and eighty degrees). In this arrangement, the resilient element further presents a region in which the axial oscillation (or axial movement) tends to zero, wherein said region—which comprises all the region located the springs of the resilient element (or resonant spring)—is known as neutral point. Furthermore, in accordance with document BRPI0601645, the mechanical attachment between the external shell of the compressor (normally cylindrical and tubular) and the resilient element shall be effectuated through said neutral point, aiming not modifying the oscillation conditions of the already mentioned elastic element.

Although the concepts and constructiveness observed in document BRPI0601645 meet all the intended objectives (in ideal operating situations), it shall be noted the lack of axial stiffness necessary for maintaining the positioning of the resonant oscillating mechanism in the interior of the shell in situations wherein it is noted the unbalance of mass or stiffness (neutral point with oscillation different from zero), which may occur due to several reasons (non-ideal situations).

To overcome this unfavorable aspect, the current state of the art further provides an arrangement of linear compressor (based on a resonant oscillating mechanism) wherein it is included an intermediate element among the compressor shell and the resilient element.

This arrangement including an intermediate element is defined, in detail, in the Brazilian document No. BRPI1005184 of Dec. 27, 2010, which is also applied to the same author of the present application.

Thus, it is defined an intermediate element composed by an integrated tubular body, at least a group of rips (which defines an axially flexible surface), and at least one attaching point for the resilient element or resonant spring. Specifically, it is provided two symmetrically-arranged attaching points, wherein each one of the attaching points comprises a thru hole defined in the axially flexible surface. According to said document, the intermediate element is arranged in the interior of the compressor shell, and the resonant spring is arranged in the interior of the intermediate element. This arrangement is fixed with bolts and similar tools, which pass through the axially flexible surface of the intermediate element and the neutral point of the resonant spring.

The Brazilian document No. BRPI1005184 further discloses the presence of flat leaf springs assembled together with the side faces of the intermediate element. Said flat springs have the function of increasing the transverse stiffness between the resonant oscillating assembly and the compressor shell and further guaranteeing that occasional concentricity errors (of the resonant oscillating assembly) will be reduced.

If said flat leaf springs do not have an angular indexing related to the resilient element that connects the magnet to the piston, the transverse vibration of the compressor, measured in two transverse directions, one direction on the base plan of the compressor (bottom) orthogonally to the direction of the piston motion and the other direction on the vertical plan orthogonally to the piston motion, will also have a variability that will follow the position of spring legs. Considering the indexing, the forces transmitted to the shell by the spring legs will have a fixed position. Consequently, the vibration caused by said forces will have a lower variability.

The lack of indexing can also result in a concurrence (coincidence) between the frequencies of some vibration modes and some harmonicas of functioning, resulting in the increase of compressor vibration, or even its non-operation.

In view of the foregoing, it remains obvious the need of developing a linear compressor based on a resonant oscillating mechanism not containing the disadvantages described above.

OBJECTIVES OF THE INVENTION

Thus, one of the objectives of the present invention is the disclosure of a linear compressor based on a resonant oscillating mechanism whose alignment of their means of support is capable of mitigating the vibration level of the compressor. In this sense, it is another objective of the present invention the alignment of the means of support being capable of reducing the variability of the vibration level of the compressor.

Furthermore, it is another objective of the present invention the disclosure of a linear compressor based on a resonant oscillating mechanism whose alignment of their means of support is capable of avoiding the occurrence of coincidences related to some frequencies and some harmonicas of functioning.

SUMMARY OF THE INVENTION

These and other objectives of the instant revealed invention are completely achieved by the arrangement of components of a linear compressor, which is fundamentally composed by at least one resonant spring, which defines at least one attaching region of neutral point, at least one magnet and at least one piston, at least one flat spring, which defines at least one binding structure, at least one shell and at least one attaching means.

The arrangement of components of a linear compressor is different due to the fact that: at least one axially flexible surface of the intermediate element is physically attached to at least one region of neutral point of the resonant spring by means of an attaching means; at least one flat spring is mechanically attached to at least one end of the intermediate element; at least one axially flexible surface of the intermediate element is aligned, in a radial way, with at least one attaching means of at least one neutral point of the resonant spring; at least one binding structure between the flexible region and the external diameter (which characterizes the "leg" of the flat spring) of at least one flat spring is axially aligned with at least one attaching means.

Preferably, the arrangement of components of a linear compressor includes at least two diametrically-opposed physical attachments between the axially flexible surfaces of the intermediate element and at least one neutral point of the resonant spring.

According to the preferred concepts of the present invention, each end of the intermediate element provides the mechanical attachment of at least one flat spring. In this sense, the flat springs arranged in the ends of the intermediate element have their binding structures axially aligned.

CONCISE DESCRIPTION OF THE DRAWINGS

The present invention will be detailed with basis on the figures described as follows:

FIG. 1 illustrates, in a schematic manner, a perspective view of a linear compressor, in accordance with the present invention;

FIG. 2.1 illustrates, in a schematic manner, an exploded perspective view of a linear compressor, in accordance with the present invention;

FIG. 2.2 illustrates an exploded perspective view of movable elements of a linear compressor;

FIG. 3.1 illustrates a cut view of the linear compressor assembled in accordance with a preferred embodiment of the present invention; and FIG. 3.2 illustrates an enlarged cut view of the movable elements of the compressor represented in FIG. 3.1.

DETAILED DESCRIPTION OF THE INVENTION

As previously mentioned, the present invention refers to an arrangement of components comprised in a linear compressor capable of optimizing the functioning thereof, reducing vibrations and avoiding the occurrence of eventual functional problems caused by specifically undesired vibrations.

Thus, the arrangement of components that compose a linear compressor provides several radial and axial alignments of their components, especially an alignment related to the location of the attaching means of neutral point of the resonant spring, between the intermediate element and the flat springs.

A preferred embodiment of the present invention is illustrated in FIGS. 1, 2, and 3.

In said figures it is illustrated a movable mechanical assembly of a linear compressor 1 based on a resonant oscillating mechanism.

The linear compressor 1 is composed by a resonant spring 2, which includes a magnet 3 of an electrical engine arranged in one of the ends thereof, and a piston 4 arranged in the other end. The magnet 3 and the piston 4 are provided with other support and connection elements.

The resonant spring 2 comprises a metallic and substantially helical body, further presenting a neutral point 21 (which tends to not present oscillations and/or vibrations when the linear compressor 1 is working).

The electrical engine comprises a linear electrical engine embodied by a fixed portion (in relation to the resonant oscillating assembly) and a movable magnet 3 (capable of presenting an axial shift from the interior of the compressor 1).

The piston 4 comprises a half-passing cylindrical body and also other support and connection elements (such as, for example, a connecting rod, a guide, and others).

The resonant oscillating assembly formed by a resonant spring 2, a magnet 3, and a piston 4, is already known by the skilled in the art; in other words, it is already disclosed in prior art documents.

The resonant oscillating assembly of the linear compressor 1 is arranged in the interior of the intermediate body 5, which preferably comprises a body that is similar to the object described in the Brazilian document No. BRPI1005184, in other words, it has at least one axially flexible surface 51.

The attachment between the resonant oscillating assembly (specially, the resonant spring 2) and the intermediate body 5 results from the connection (supported by an attaching means 8) of the axially flexible surface 51, of the intermediate body 5, to the attaching region of the neutral point of the resonant spring 2. This type of attachment enables that all the resonant oscillating assembly presents a certain degree of axial movement.

The linear compressor 1 further includes two flat springs 6 (or even assemblies or leaf springs analogous to said springs 6), which are fundamentally composed by an external portion 61, binding structures 62, and an internal portion 63. Preferably, the external 61 and internal 63 portions are defined by circumferential rings having dimensions that are analogous to the dimensions of the respective ends 52 of the intermediate element 5 and to the attaching elements (not detailed) of the magnet 3 and piston 4.

In this sense, the external portion 61 of each flat spring 6 is attached to one of the ends 52 of the intermediate element 5, preferably, by means of a mechanical resealing.

The internal portion 63 of each flat spring 6 is attached to either the attaching elements of the magnet 3 or the attaching elements of the piston 4.

Notably, the binding structures 62 have the objective of connecting the external portion 61 to the internal portion 63.

The linear compressor 1 is further composed by a shell 7, which—fundamentally—comprises a tube dedicated for positioning the intermediate element 5.

Taking into consideration the conceptual point of view, the majority of such constructive features is already defined in the Brazilian documents (also property of the instant Applicant) BRPI0601645 e No. BRPI1005184.

According to the present invention, the arrangement of components that compose a linear compressor provides the physical attachment between axially flexible surfaces 51 of the intermediate element 5 and the attaching region of neutral point 21 of the resonant spring 2 by means of at least one attaching means 8 (preferably, a bolt). In this case, the axially flexible surfaces 51 of the intermediate element 5 are aligned, in a radial way, with the neutral point 21 of the resonant spring 2.

Moreover, and also in accordance with the present invention, the arrangement of components that compose a linear compressor provides the mechanical attachment of a flat spring 6 (or flat leaf springs) and the ends 52 of an intermediate element 5. In this case, at least one end of at least one of the binding structures 62 of a flat spring 6 (or flat leaf springs) is axially aligned with an attaching means 8, and, consequently, aligned with the attaching region of the neutral point 21 of the resonant spring 2 and with the axially flexible surfaces 51 of the intermediate element 5.

Upon considering the axial alignment of the binding structure 62 of a flat spring 6 with an attaching means 8, the forces transmitted to the shell 7 through the legs of the flat springs 6 will have a fixed angular position and, consequently, the vibration caused by said forces will present a lower variability.

The lack of the axial alignment may also result in a concurrence (coincidence) between the frequencies of some vibration modes and some harmonicas of functioning, resulting in the increase of compressor 1 vibration, or even its non-operation.

The above-mentioned refers to an example of a preferred embodiment. Thus, it shall be noted that the scope of the invention includes other possible modifications, being only restricted by the content of the claims, therein considered possible equivalent means.

The invention claimed is:

1. An arrangement of components of a linear compressor (1) comprising:

wherein said linear compressor is fundamentally composed by at least one resonant oscillating mechanism comprising at least one resonant spring (2) which defines at least one attaching region of neutral point (21), at least one magnet (3) and at least one piston (4);

at least one shell (7); and at least one attaching means (8);

said arrangement of components of the linear compressor further comprising, at least one intermediate element (5) which defines an axially flexible surface (51);

at least one flat spring (6) which defines at least one binding structure (62) wherein:

the resonant spring (2), the magnet (3), and the piston (4) are arranged in the interior of said at least one intermediate element (5);

the axially flexible surface (51) of the at least one intermediate element (5) is physically attached to at least one region of the neutral point (21) of the resonant spring (2) by means of said attaching means (8), said at least one intermediate element (5) being disposed inside the at least one shell (7);

the at least one flat spring (6) is mechanically attached to at least one of the ends (52) of the at least one intermediate element (5);

the axially flexible surface (51) of the at least one intermediate element (5) is aligned, in a radial way, with at least one attaching region of the neutral point (21) of the resonant spring (2); and at least an end of the at least one binding structure (62) of said at least one flat spring (6) is axially aligned with said at least one attaching means (8).

2. An arrangement of components of a linear compressor, in accordance with claim 1, characterized in that it provides at least two physical attachments between the axially flexible surface (51) of the at least one intermediate element (5) and the at least one neutral point (21) of the resonant spring (2).

3. An arrangement of components of a linear compressor, in accordance with claim 1, characterized in that each end (52) of the at least one intermediate element (5) provides the mechanical attachment of said at least one flat spring (6).

4. An arrangement of components of a linear compressor, in accordance with claim 1 or 3, characterized in that said at least one flat spring (6), which are arranged in the ends (52) of the at least one intermediate element (5), have their at least one binding structure (62) axially aligned.

* * * * *